US006412416B1

(12) United States Patent
Rouse et al.

(10) Patent No.: US 6,412,416 B1
(45) Date of Patent: Jul. 2, 2002

(54) PROPELLANT-BASED AEROSOL GENERATION DEVICES AND METHOD

(75) Inventors: William G. Rouse, Havre De Grace; Raymond J. Maleck, Perry Hall, both of MD (US); Daniel J. Hartman, Orlando, FL (US); Noel Gonzalez; Daniel M. Jackson, both of Oviedo, FL (US); Walter T. Robinson, Pegram, TN (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/811,752

(22) Filed: Mar. 19, 2001

(51) Int. Cl.[7] ..... F42B 4/26; F42B 12/46

(52) U.S. Cl. ..... 102/336; 102/370; 102/334; 102/505

(58) Field of Search ..... 102/334, 336, 102/367, 370, 505

(56) References Cited

U.S. PATENT DOCUMENTS

| | | | | | |
|---|---|---|---|---|---|
| 3,711,115 | A | * | 1/1973 | Lohr | 102/367 X |
| 3,785,674 | A | * | 1/1974 | Poole | 280/150 |
| 4,636,364 | A | * | 1/1987 | Geyer et al. | 102/334 X |
| 5,148,173 | A | * | 9/1992 | Rouse | 342/3 |
| 5,359,918 | A | * | 11/1994 | Meili et al. | 102/505 X |
| 5,402,729 | A | * | 4/1995 | Richert | 102/334 X |
| 5,661,257 | A | * | 8/1997 | Nielson et al. | 102/334 |
| 5,668,345 | A | * | 9/1997 | Schroeder et al. | 102/289 |
| 5,772,243 | A | * | 6/1998 | Green | 280/741 |
| 6,047,644 | A | | 4/2000 | Malecki et al. | 102/367 |

* cited by examiner

*Primary Examiner*—Peter A. Nelson
(74) *Attorney, Agent, or Firm*—Ulysses John Biffoni

(57) ABSTRACT

Disclosed is an aerosol generating device comprising a cartridge containing a propellant. When ignited, propellant gases expand through a diffuser, then through and into a clearing pad and then through and into a filler area, thereby de-agglomerating and fluidizing the filler and increasing pressure until a frangible end seal on the retainer end of the cartridge ruptures and releases the filler as an aerosol cloud. Methods for disseminating an aerosol and for using the device are also disclosed.

13 Claims, 1 Drawing Sheet

PROPELLANT-BASED AEROSOL GENERATION DEVICES AND METHOD

GOVERNMENT INTEREST

The invention described herein may be manufactured, licensed, and used by or for the U.S. Government.

BACKGROUND OF THE INVENTION

1. Field of the Invention

The present invention relates to devices and methods for aerosol dispersion. More particularly, the claimed devices and methods use propellant gas generation. Most particularly, the devices and methods provide a non-explosive means for propellant disseminated aerosol payloads for military and civilian purposes.

2. Brief Description of the Related Art

Aerosols are the suspension of solid or liquid particles in the atmosphere. Aerosols are used in the military to defensively position and protect combat forces. During operations, a military force may be targeted visually or by means of ultraviolet, infrared (IR) or millimeter (MM) wave radar sensors. To counter this targeting, various types of filler payloads are used for aerosol dissemination, thereby obscuring and protecting the potential targets. These payloads include smokes to prevent visual detection, brass flakes that interfere with IR tracking and carbon fiber payloads to block energy in the MM region of the electromagnetic spectrum.

The military uses high explosive (HE) devices or grenades to disperse a variety of particle payloads into the atmosphere. HE devices and grenades, however, create a fragmentation hazard. In addition, both employ time delays, i.e., there is a delay from the time the grenade is fired until it explodes and creates an aerosol cloud. The military also uses pneumatic means, such as bleed air from a turbine engine, to disseminate aerosols. However, these aerosol systems are dependent on the vehicle as a source of dissemination air.

In addition, the prior art of military smoke pots can only screen in the visible and near infrared regions of the electromagnetic spectrum because the prior art relies on chemical decomposition of the filler to generate the gases that force the obscurant (a product of the decomposition reaction) into the atmosphere. The reliance on decomposition of the aerosol filler limits the prior art to the visible and near infrared spectrum because fillers that screen the far infrared and millimeter spectrum do not undergo such decomposition reactions. Attempts have been made to mix such fillers with those that decompose, but the results have been poor, i.e., the fillers that do not decompose are melted, destroyed or otherwise not lofted into the atmosphere.

Aerosols are also used in the civilian world for police and firefighting purposes. Police disperse riot control aerosols into crowds and as personal protectants and incapacitating agents. Firefighters use aerosols to remove fire sustaining elements, such as heat and oxygen. Currently, aerosols used by police and firefighters are provided by either spray containers, or grenades, that generally require an initiation time delay or by remote hoses or vehicles.

In view of the foregoing, improvements in the dispersal of aerosols are needed. The present invention addresses these needs by providing devices and methods for rapid aerosol dissemination. The present invention operates according to many of the principles disclosed in U.S. Pat. No. 6,047,644, which was issued to Applicant on Apr. 11, 2000, and which discloses an aerosol-filled cartridge that uses gases from ignited propellant to disperse the aerosol fill directly into the atmosphere. The present invention, however, includes elements, features and methods not disclosed or claimed in the '644 patent.

SUMMARY OF THE INVENTION

The present invention includes a device comprising at least one cartridge formed by a casing having a base end and a retainer end; a firing initiator mounted in the base end and extending to a propellant near the base end of the casing; a diffuser inside the casing and on a side of the propellant opposite the base end; a clearing pad adjacent to the diffuser on a side of the diffuser opposite the base end; a filler area inside the casing and adjacent to the clearing pad on a side of the clearing pad opposite the base end, the filler area containing filler capable of forming an aerosol; and a frangible end seal in the retainer end of the casing. Preferably, the propellant's rate of reaction is slower than that of an explosive that generates a shock wave traveling at 2000 meters per second. More preferably, the propellant is a double-base propellant. A double-base propellant contains two active ingredients, generally nitrocellulose and nitroglycerine.

A preferred embodiment of the present invention is based on an M2A1 ammunition-type carrying case and includes a housing containing multiple cylindrical or substantially cylindrical versions of the above-described cartridges; an electric firing initiator controlled by an electronic control unit; a paper, wax or cloth membrane inside of each casing and adjacent to each diffuser on a side opposite the propellant; a clearing pad inside of each casing and adjacent to the diffuser or membrane on a side opposite the propellant; and wherein the filler is a powder having interstitial void space between the particles.

In a preferred embodiment, the invention comprises a single man-portable unit that provides sequenced dissemination of multiple aerosol plumes and the use of propellant gas generation in the instantaneous formation of those plumes. Such a device can be ground-employed like standard military smoke pots and used to release aerosols in a planned manner to screen military objectives.

Unlike prior art military smoke pots, which rely on decomposition of the filler itself as opposed to decomposition of a separate propellant, this invention can screen not only the visible region but also the infrared and the millimeter regions, depending on the type of filler. A titanium dioxide $TiO_2$ fill can be used to screen in the visible region, graphite or brass flake can be used to screen in the infrared region and carbon fiber can be used to screen in the millimeter region. A combination of fill materials can be tailored so that more than one region can be screened simultaneously. The device can also be mounted on armored and wheeled vehicles for generating a continuous sequence of plumes for increasing vehicle self-protection from detection and hit acquisition from threat munitions.

The invention also encompasses various methods. One preferred method of use involves daisy chaining a plurality of the devices together in a master-slave network to achieve long and continuous aerosol clouds. Another preferred method of use is as a vehicle self-protection screening device. Another is as a crowd control device.

Also disclosed is a method for disseminating an aerosol by igniting a propellant within at least one solid container having a frangible end and containing filler capable of forming an aerosol. Preferably, the filler does not chemically decompose within the container, the propellant burns in an area of the container separate from the filler and the reaction rate of the propellant is less than that of an explosive that generates a shock wave traveling at 2000 meters per second. It is also preferable that the propellant be a double-base propellant, that the propellant and the filler be separated by a diffuser and that a clearing pad adjacent to the diffuser on a side opposite the propellant help sweep the filler out of the container after the propellant has been ignited. The igniting may be initiated by an electrical signal.

DETAILED DESCRIPTION OF THE PREFERRED EMBODIMENTS

The present invention is a device used for aerosol dispersal and methods of aerosol dispersal using the claimed device and other devices capable of using propellants, rather than explosives, pre-pressurized gas or pneumatic means. The aerosol dispersal devices and methods permit easy handling and dissemination of the aerosols in combat and non-combat operations.

Figure 1:
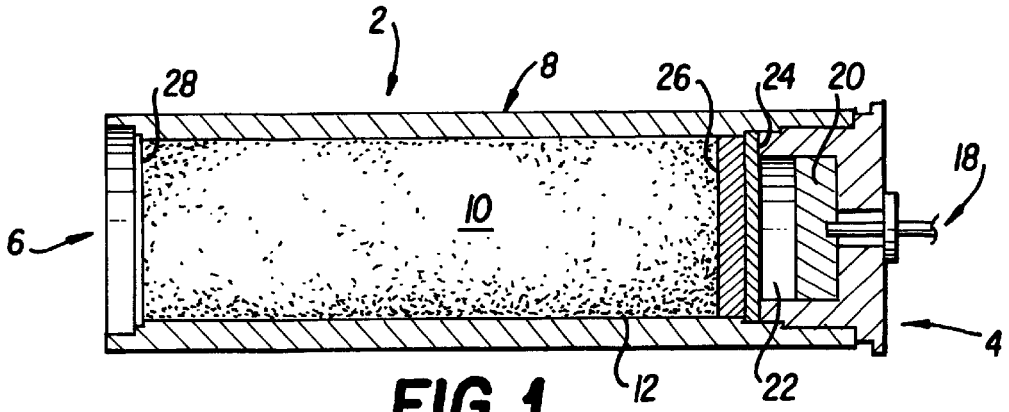
FIG. 1 is an illustration of a cross-sectional view of an embodiment of the present invention.

As seen in FIG. 1, a preferred embodiment of the invention comprises a cartridge 2 comprising a casing 8 having a base end 4 and a retainer end 6. Casing 8 is made of any material or construction that permits the containment of filler 10 within a filler area 12 and is sufficiently strong to withstand the internal pressure generated by the propellant. Preferably, the material is a hard, relatively strong material such as plastic, ceramic or metal. More preferably, it is a metal, most preferably aluminum. In the preferred embodiment, casing 8 has a cylindrical or substantially cylindrical construction with a length of from about 2 inches to about 6 inches, preferably from about 4 inches to about 5 inches. The diameter, or width, of casing 8 is preferably from about 1 inch to about 4 inches, more preferably from about 1 inch to about 3 inches, and most preferably about 1.57 inches. The length and width of the casing 8 are such as to allow maximum dispersion of filler 10 into an aerosol. The width, length and other dimensions of the casing 8 may vary according to factors such as propellant strength, void spacing and the like.

The base end 4 contains a firing initiator 18 connected to propellant 20. The initiator 18 may be any source of ignition or primer that is capable of initiating burn of the propellant 20. Preferably, initiator 18 is an electric match comprising an electrical squib and cable.

The propellant 20 is not a high-explosive charge. Compared with high explosives it is relatively slow burning. Compared with many other propellants it is relatively fast burning. Burning propellant 20 produces gas generation, creating large amounts of gas over a short period of time. Large amounts of gas are those amounts that are capable of effectively fluidizing the filler 10 as the gases from the propellant 20 travel into the filler area 12.

The choice of propellant 20 is crucial for optimal dissemination of the aerosol. The primary criterion is the burning rate. Too slow a burn rate increases the time to release, allowing time for the propellant gases to react with some fillers, especially metal fillers. It also may not generate enough power to efficiently disseminate the filler into a fully aerosolized plume.

An extraordinarily fast burning rate, on the other hand, approximates an undesirable explosion. Both explosives and propellants that have been properly initiated evolve large volumes of hot gas in a short time. The difference between explosives and propellants is the rate at which the reaction proceeds. In explosives, a fast reaction produces a very high pressure shock in the surrounding medium. This shock is capable of shattering objects. In propellants, a slower reaction produces lower pressure over a longer period of time. This lower, sustained pressure is used to propel objects.

Burning and detonation of such energetic materials are exothermic redox reactions that are self-sustaining after an initial activating energy has been applied. On the basis of mass, the amount of energy released by propellants and explosives is comparable. However, this energy is considerably less than is produced by common fuels such as carbon burning in air.

Propellant burning, or deflagration, is the very rapid burning that results from having a fuel and an oxidant in very close contact. In some propellants such as nitrocellulose, the fuel (which consists mainly of hydrogen and carbon) and oxygen are parts of the same chemical compound. In other propellants, finely divided discrete fuels and oxidents are mixed. The fuel may be a hydrocarbon or other readily oxidizable material such as aluminum. The oxidizer is usually an inorganic compound such as ammonium perchlorate or ammonium nitrate which contain oxygen in excess of the amount required for their own oxidation.

Deflagration of propellants proceeds the same as normal burning. Combustion takes place on the surface and proceeds into the grain. The rate determining factors in the reaction are the rate of heat transfer into the propellant grain from the burning surface and the rate of decomposition of the propellant formulation. The rate of heat transfer depends on the pressure of the combustion products. The burning rate is defined as the rate at which the burning surface consumes a propellant grain in a direction normal to the grain surface.

Detonation of explosives is different from deflagration. A shock wave moving at supersonic speed proceeds through the explosive causing decomposition of the explosive material. The reaction rate is determined by the velocity of the shock wave, not by the rate of heat transfer. The velocity of the shock wave depends on the physical characteristics of the individual explosive material. The range of velocities is from about 2,000 meters per second to about 9,000 meters per second. The factors that affect the velocity include density, degree of confinement, and geometric configuration of the charge.

Propellants are divided into four classes: single base, double-base, triple-base, and composite. Division of the propellants into these classes is on the basis of composition, not use. Single-base propellants are low-cost propellants that have a low flame temperature and low energy content, and contain such compositions as nitrocellulose. Double-base propellants are more energetic than single-base propellants, and may contain such compositions as nitrocellulose gelatinized by nitroglycerin. Triple-base propellants generally contain nitroguanidine as an additional energizer, which increases the energy content for the composition without raising the flame temperature. Composite propellants contain a polymer binder, a fuel, and an oxidizer.

Preferably, the propellant 20 is double-base. Again, this term has been applied generally to compositions containing both nitrocellulose and nitroglycerin. However, since other gelatinizers such as DEGN are used by other countries, a better definition of a double-base composition is one containing nitrocellulose and a liquid organic nitrate which will gelatinize nitrocellulose. Like single-base propellants, double-base propellants frequently contain additives in addition to a stabilizer. Most preferably, the propellant 20 is 2.5 grams of Alliant® Red Dot, a double-base compound that generates about 0.03 cubic feet of gas per gram of propellant at sea level.

The casing 8 may further contain an open area 22 adjacent to the propellant 20 on the side opposite base end 4. The open area 22 allows for expansion of the propellant gases after propellant 20 has ignited. Preferably, the ratio of the volume of open area 22 to the volume of propellant 20 is 1 to 10, more preferably 1 to 5, and most preferably 1 to 3.

Adjacent to open area 22 on the side opposite base end 4 is the diffuser 24. Thus, the diffuser 24 is between the open area 22 and the filler area 12. Through openings in diffuser 24, gases generated from the ignited propellant 20 travel into filler area 12. The diffuser 24 is a hard material such as plastic, ceramic or metal. Preferably, the diffuser 24 is metal. The diffuser 24 is preferably a circular plate with a plurality of holes incorporated into the plate that allow an even distribution of gas flow from the ignited propellant toward the clearing pad 26 and filler area 12.

Flow rate of gases into the filler area 12 varies by the ratio of the diffuser hole area to the filler area 12. The hole number and size are varied depending on the size of the cartridge 2 and the amount of propellant 20 and filler 10 used. For a 40 mm cartridge, the diffuser 24 preferably has from about 2 to about 20 holes, more preferably from about 4 to about 10 holes, most preferably from 7–8 holes. The size of the holes is preferably from 0.26 inches diameter to about 0.36 inches diameter, more preferably about 0.302 inches. The hole's circular pattern diameter is preferably about 1.0 inches. (Hole circular pattern diameter is the diameter of the smallest circle that can be formed by drawing a curved line through the centers of six neighboring holes.) The diffuser 24 has a thin width of from about 0.0625 inches to about 0.25 inches, more preferably from about 0.125 inches to about 0.1875 inches, most preferably about 0.125 inches.

The holes are covered by a frangible paper thin membrane (not shown) to retain the filler 10 and the propellant 20 in their respective areas. This sheet may be any material that facilitates this separation, such as paper, fabrics and metal like aluminum foil. Preferably, the holes are covered by adhesive backed paper.

Before reaching the filler area 12, the expanding gases flow into and through a clearing pad 26, which is a thin piece of porous material between the diffuser 24 and the filler 10. The clearing pad 26 is preferably a felt wafer cut to a diameter slightly larger than the inside diameter of the casing 8. The clearing pad 26 allows the propellant gases to pass through its fabric weave to pressurize the filler area 12 prior to rupture of the burst diaphragm or frangible end seal 28 located at the retainer end 6 of the casing 8. Once the end seal 28 ruptures, the filler 10 is expelled with the clearing pad 26 being the last material forced from the cartridge. As the clearing pad is expelled, it wipes the filler area 12 clean of any retained filler 10. By sweeping out retained filler 10, the clearing pad 26 eliminates residual material burn, thereby suppressing flash. Before being expelled, the clearing pad 26 also serves to further diffuse the propellant gases.

The filler area 12 is located inside the casing 8 adjacent to the clearing pad 26 on the side opposite the base end 4, and extends between the clearing pad 26 and the end seal 28. The filler area 12 is preferably from about 1.0 inches to about 6.0 inches long, more preferably about 5.25 inches long. Its volume is preferably from about 2.00 $in^3$ to about 12.0 $in^3$, most preferably about 10.6 $in^3$.

The filler 10 is preferably a powder with void areas or interstitial void space between the particles. Expanding gas from the propellant 20 flows into the interstitial void space between the particles. The expanding gas de-agglomerates the particles and dissipates the total mass of material. Preferably, the volume ratio of filler 10 to void space between the particles within the filler area 12 is from about 20:80 to about 80:20, more preferably from about 20:80 to about 50:50, most preferably about 30:70.

The filler 10 includes military payloads of screening obscurants, such as titanium dioxide, brass flakes, carbon flakes and fibers, graphite flakes, smoke, chaff and the like. Additionally, civilian payloads of riot control agents, such as Ortho-chlorobenzalmalononitrile (CS) and Oleoresin Capsicm (OC) and dye indicators, sticky foams, fire retardants and the like may be used for law enforcement and firefighting uses. When granular obscurants are used as filler 10, the granules preferably have diameters ranging from about 0.5 microns to about 2.0 microns in diameter. When flakes or irregular plate-shaped particles are used, preferably they have diameters ranging from about 1.0 microns to about 100 microns. When fibrous materials are used, such as carbon fibers, which are electrically conductive cylinder shaped dipoles, the diameters of the fibers preferably range from about 3.5 microns to about 20 microns.

To the extent that the gases flow through the clearing pad 26, as opposed to pushing along the clearing pad itself, they then flow into and through the filler 10. The high-pressure gases increase the fluidity of the filler 10 by separating the individual particles and raising the pressure in the cartridge 2 prior to bursting a portion of the end seal 28. Thereby, the frangible end seal 28 retains the filler 10 in the casing 8 until sufficient pressure is caused by expanding gases of the propellant 20. Efficient separation of fill particles by the propellant gas and proper high burst pressure leads to a characteristically short, expanded aerosolized cloud.

Preferably, the frangible end seal 28 withstands pressures of from about 100 psi to about 1500 psi prior to rupture, more preferably from about 1200 psi to about 1400 psi, and most preferably about 1350 psi. The end seal 28 is made of any material that permits retention of the filler 10 in the casing 8 until a desired pressure is reached. Preferably, the end seal 28 is made of a hard material such as plastic, ceramic or metal. More preferably, it is made of metal. Most preferably, it is a single brass shim that is retained between a top plate of the casing 8 and its cylindrical block body. The clamping force provided by threaded fasteners, which attach the top plate to the cylinder block, hold the end seal 28 in place against the high pressures generated by the propellant gas until ultimate failure loads are generated. In a working prototype, the sharp edge generated on the lower surface of the top plate during manufacture was retained so that a repeatable failure pressure was obtained resulting in a pure shear failure. The burst pressure is determined by the thickness and material properties of the brass used to form the end seal 28.

The most preferred embodiment of the invention integrates an array of cartridges filled with a solid aerosol into a housing and further integrates a power source and an electronic control unit into the housing. The control unit can be programmed to remotely initiate a sequence of aerosol plumes in a timed manner and from a safe stand-off distance. This preferred embodiment. was conceived from the idea of creating both a ground-employed munition, similar to a standard smoke pot, and a vehicle self-protection device. This dual-use device could be used by multiple units within the military, such as infantry, armor, engineers, and military police. Being self-functional and man-portable provides the flexibility to support different military functions.

Figure 2:
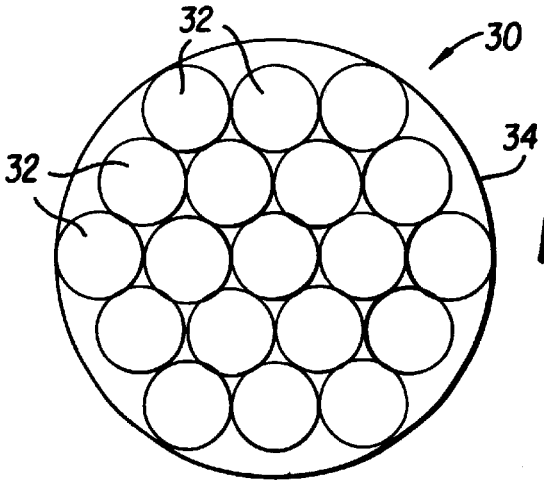
FIG. 2 is a schematic illustration of a smoke pot body, which comprises an array of cartridges contained within a housing.

In the embodiment described in the preceding paragraph, the invention comprises an array of cartridges. Although this multi-cartridge embodiment of the invention is preferably based on a standard M2A1 ammunition carrying case, which is rectangular in design, a circular design, like that of the M5 Smoke Pot, could also be used. FIG. 2 is a schematic illustration of a circular smoke pot core 30 comprising an array of 19 compartments 32 contained within an internal housing 34 that, in operation, is itself contained within an external housing or box (external housing or box not shown in FIG. 2). The compartments 32, which only contain the filler, are precursor components of the cartridges. When a smoke pot core 30 is placed inside an external housing, it attaches to the external housing's bottom plate. The bottom plate is made up of individual propellant cups. Each propellant cup contains propellant, a diffuser and a clearing pad. Beneath the center of each propellant cup is an opening in the bottom plate into which is secured a firing initiator, preferably an electric match. The propellant cups interface with each of the compartments 32 in the smoke pot core 30, thereby forming complete cartridges. It is understood that "smoke pot" core 30 is not limited to smoke-producing or obscurant fillers.

Figure 3:
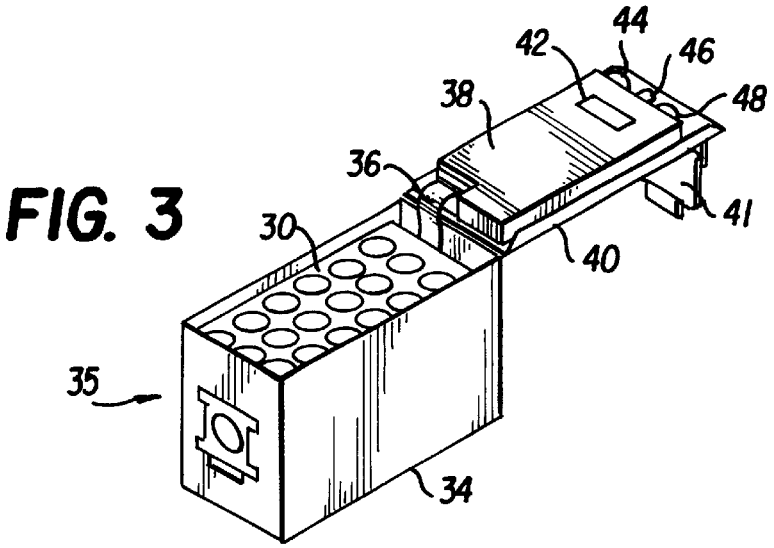
FIG. 3 is an illustration of the most preferred embodiment of the invention, a prototype based on an M2A1 ammunition carrying case.

FIG. 3 depicts the most preferred embodiment of the invention, a working prototype with multiple cartridges referred to as smoke pot 35. Smoke pot 35 is based on the M2A1 box or external housing 34, which contains a smoke pot core 30. FIG. 3 also shows an electrical ribbon cable 36 connecting Dupont® S-113A electrical squibs (not shown) underneath the cartridges to the electronic control unit 38. The control unit 38, which contains a microprocessor, is mounted to the lid 40 of the external housing 34. The control unit 38 can be incorporated in other positions within the external housing 34, such as underneath or beside the smoke pot core 30. The control unit 38, lid 40 and latch 41 can also be detached from the external housing 34. For transportation and storage safety concerns, the device is designed such that the lid 40 cannot close when the control unit 38 is connected to the firing initiator in the armed position.

The control unit 38 acts as an electrical firing sequencer to actuate the initiator within each cartridge at a predetermined (programmable) firing rate. The control unit 38 allows the operator to control the rate of smoke production, the time at which the device starts to function and how much of the total payload will be expelled. The control unit 38 may be set to produce a single, instantaneous cloud of very dense smoke or a continuous curtain of smoke for up to one minute's duration. This capability provides broad utility for the device and allows one or more units to be used in a preplanned, coordinated event. As such, it is well suited to military operations in urban terrain (MOUT) scenarios where it would allow troops to move from building to building over several city blocks under cover of smoke. It would also be effective as a sniper countermeasure, for diversion and distraction and for crowd control. A turret-mounted adaptation in conjunction with threat warning sensors could be employed for vehicle self-protection smoke applications.

FIG. 3 further depicts the control unit 38 with the LED display 42, arming switch 44, mode selection knob 46 and the on/off power switch 48 as part of the control unit 38. The on/off power switch 48 turns the control unit 38 on. The arming switch 44 allows the operator to initiate the firing sequence. The mode selection knob 46 is used to set the desired safe separation time delay, which allows the operator to retreat to a safe distance before the first event is initiated. The mode selection knob 46 also allows the operator to control the number of plumes desired and the time delay between individual plume initiation. This information is displayed to the operator on the display 42. Once the desired operational parameters are set and the arming switch 44 is toggled, the safe separation countdown begins. To provide electrical energy, a battery can be incorporated into the control unit 38, or in the housing, 34. Alternatively, a storage capacitor charged by a separate reusable charger could be used.

In the operation of an alternative embodiment, the user anchors the box down on the terrain and opens the lid to expose the control panel and the internal smoke cartridges. The ribbon cable is then connected to the controller. A power switch turns the control system on. A knob is used to set the desired safe separation time delay, the number of cartridges to be fired and the time delay between each initiation. As the settings are made, this information is displayed to the user on a LED display. Once the desired operational parameters are set, an arm switch is actuated and the safe separation countdown begins. After the safe separation countdown is completed, the unit begins to initiate the selected number of cartridges with a time delay between each cartridge as set by the user. When required, the control system produces a current greater than the all-fire current of each initiator at each of the 18 firing circuits.

As the propellant burns, gases are created in the open area. These gases quickly blow through any thin frangible membrane on the diffuser and are released through the diffuser and clearing pad in a controlled manner and into the filler area. When the filler is a solid powder, the gases flow between the particles, which causes them to fluidize. As the pressure increases, the end seal breaks, allowing the filler to be released to form an individual plume. The clearing pad also exits the cartridge at this time, sweeping along any residual material in its path. The plume preferably expands into a cloud approximately 12–15' long x 8' in diameter, which is preferably composed of approximately 250 grams of dispersed aerosolized material. This is then followed by the next initiation. Each firing initiation is preferably separated by 2–5 seconds. More preferably, a cartridge is fired every 3.3 seconds. This firing interval is long enough so that the individual plume has time to expand before being fully controlled by environmental transport and diffusion by the wind, yet short enough that the plume forms a relatively continuous cloud with the next plume.

A continuously generated aerosol plume or cloud may be created by firing multiple cartridges within a given area. The cartridges, which are approximately 5.25 inches long and 1.6 inches (40 mm) in inside diameter, contain approximately 250 grams of solid aerosol filler and 2.5 grams of propellant. They are preferably fired in 3.3 second intervals, which produces an output equivalent to an Army M56 smoke generator at its maximum IR obscurant consumption rate of 10 pounds per minute. The total screening capacity from an 18-cartridge device when filled with brass flake is approximately one minute long when each cartridge is fired at 3.3 second intervals. Ten such devices can provide a ten minute infrared screen.

The aerosol generation may be performed by individuals, such as soldiers in the field or downed aircrews awaiting the arrival of rescue teams, using a single shot pistol or multiple shotgun device. Additionally, the aerosol generation may be done from any platform suited for the purpose, such as a truck, tank, aircraft, sea-going vessel and the like. Multiple firings of 40 mm cartridges from an automatic granade launcher, such as the Army's M129, could be used to create continuous trailing aerosol smoke screens.

The above-described preferred embodiment thus comprises a small, man-portable, self-contained, electronically controlled, pyrotechnically initiated, aerosol generation device. The invention provides for aerosol formation without high explosives, grenades, pre-pressurized gases or pneumatic means. It provides instant dissemination of multiple types of aerosol in a localized area without fragmentation hazards.

Exemplary Devices

With a prototype, an obscuration cloud was produced by the production of 18 smaller, individual smoke plumes that were produced at a specific time delay interval. Each of the 18 cartridges is 40 mm (1.57 inches) in diameter with an overall height of 12.7 cm (5 inches). The external housing of the prototype device comprises a standard, metal ammunition box (M2A1) with a top opening, single hinge lid. External dimensions are 11" long×5.7" wide×7" tall and the unit weighs a maximum of 32 pounds, depending on the type of obscurant or aerosol filler used. For example, the total fill weight per smoke pot unit is 7.1 pounds for fine titanium dioxide ($TiO_2$) powder, 10.3 pounds for brass flake and 3.8 pounds for chopped graphite fiber. This system is controlled by an electronic control unit that is attached to the inside of the ammunition box. A single ribbon cable transfers the firing signals from the controller to the cartridges.

The screening agent employed for visual screening was $TiO_2$ with no additives, the same material used for the smoke fill in the M82 training smoke grenade. The infrared screening agent was brass flake powder of the same type used in the M76 screening grenade. The millimeter-screening fill was chopped graphite fiber. Two MM fill configurations, aligned fiber wafers and DensePack®, were tested. DensePack® consists of two-dimensional bundles of chopped fiber cut from a single tow. These flat chips were arranged in a coplanar manner within the compartments with a random fiber directional alignment in the horizontal plane. The aligned fiber wafers consisted of a coaxal bundle of chopped fibers held in vertical alignment with an external circular ring. The packaging densities of the aligned fiber wafers were higher than that of DensePack®.

To pack the brass and $TiO_2$ filler under a high load by means of a manual press, a hole was bored into the press rod to allow trapped air to escape from the filler area during the loading operation without loss of the finely powdered filler.

A number of trials were conducted wherein the smoke pots were operated in a rapid pulsing fashion so as to produce a single dense composite Cloud to provide a Rapid Obscurant System (ROS) function. In these trials, six cartridges at a time were fired at an interval of 0.1 seconds. In this manner, three trials were obtained from a single smoke pot. Table 1 summarizes the specifications for the prototype.

TABLE 1

Specification summary for smoke pot dispenser.

| | | | |
|---|---|---|---|
| Overall size | 11.0" L × 7.0" H × 5.7" W | | |
| Number of cartridges | 18 per unit | | |
| Cartridge size | 40 mm diameter, 12.7 cm long | | |
| Weight, empty (lbs.) | 21.7 | | |
| Filler screening agent | visual $TiO_2$ | infrared brass flk | millimeter carbon fbr |
| fill mass per smoke pot (lbs.) | 7.1 | 10.3 | 3.8 |
| Total unit weight (lbs.) | 28.8 | 32 | 25.5 |
| Propellant Description | 2–3 g, fast burning, smokeless | | |
| Initiator | electric match | | |
| Internal battery power | 2 Commercial D cells | | |
| End seal burst pressure | 1350 psi | | |
| Control unit settings | | | |
| safe separation delay | 2–10 minutes, 1 sec. increments default is 2 minutes | | |
| number of cartridges | 1–18, default is 18 | | |
| firing interval | 0.1–5.0 sec., 0.1 sec increments | | |

In other trials, the controller was set to provide a longer interval between pulses so as to produce contiguous plumes over a longer duration. This is referred to as the Obscurant Reinforcing System (ORS) function. In these instances, a firing interval of either 1.7 seconds or 3.3 seconds was employed, giving an effective cloud from an initiation formation time of either 30 seconds or 60 seconds for a single smoke pot. In all of the trials, the device proved to be fast, simple and convenient to operate.

Exemplary Methods

The present invention includes a method for disseminating an aerosol by igniting a propellant within at least one solid container having frangible end (such as cartridge 2, compartment 32 and the like) containing filler capable of forming an aerosol. Preferably, the filler does not chemically decompose within said container, the propellant burns in an area of the container separate from the filler and the reaction rate of the propellant is less than that of an explosive that generates a shock wave traveling at 2000 meters per second. It is also preferred that the propellant and filler be separated by a diffuser. Still more preferably, a clearing pad adjacent to the diffuser on a side opposite the propellant helps sweep the filler out of the container after the propellant has been ignited. The ignition may be initiated by an electrical signal.

For ground-based usage, the smoke pot could be enhanced by adding the ability to daisy chain multiple smoke pots into a network. Each smoke pot would feature an additional connector that allows multiple units to be connected together. The network would consist of a single master smoke pot and any number of slave units. The master unit would be programmed by the user to define how the slave units function. Long patch cables would allow the slave units to be spaced apart and arranged in some pattern, providing a larger area smoke screen. The pots could be set to function in sequence, simultaneously or in waves and so on. One could even utilize slave units containing different obscurant types.

Another preferred method of use for this invention is as a vehicle self-protection screening device. Screening clouds can be employed for vehicle self-protection purposes, either rapidly in quick bursts, creating several clouds that are typical of Rapid Obscuration Systems (ROS), or more slowly, generating contiguous long trailing clouds that are typical of Obscuration Reinforcing Systems (ORS). The rate of fire for ROS is about one cartridge every 1/10 second. The rate of fire for ORS is about one every 2–5 seconds.

In the prior art, ROS uses high-explosive grenades fired a distance from the vehicle from vehicle mounted dischargers. This invention uses propellant instead of a high explosive central burster to disseminate the filler material. Also, this invention does not require a separate grenade and discharger system as found in ROS.

ROS grenades have a built-in delay time, which is the flight time to explosive initiation, to form dispersed obscurant clouds. The propellant disseminated aerosol expelled in this invention creates an instantaneous cloud generation from the point of initiation and does not require grenade flight or a delay time (although such features may be incorporated). Thus, the dissemination event can be initiated faster than current high-explosive grenades for a quicker screening response against threats. ROS grenades also pose a fragmentation hazard to personnel in the immediate grenade burst area. In the present invention, only the contents of the cartridge are launched, resulting in a lower fragmentation hazard.

Obscuration Reinforcing Systems (ORS) constitute other methods of vehicle self-protection. ORS can be found on various military vehicles dedicated to generating large area obscurant clouds and are dependent on a source of energy from the vehicle, such as hot engine exhaust air or high velocity engine bleed air, to vaporize or loft obscurant material. The present invention does not require any source of vehicle supplied air to aid in dissemination.

The device can be modified to be mounted on brackets directly onto a vehicle and connected directly to the vehicle's electrical system to initiate firing. The mountable device also has the potential to be incorporated into an integrated defense system along with an automatically controlled turret and sensors. It could be adapted to either a fixed installation mount or a two-axis motor-driven turret. The firing control could also be integrated with the vehicle threat detection sensors and countermeasures system. It would also be possible to devise an autoloader for use with the invention.

Despite its ability to operate without being projected, the multi-cartridge smoke pot version of the invention could be adapted as a launcher unit. The smoke pot would preferably house 18 individual cartridges that would be projected out of the dispenser by means of a gas generating impulse launcher in a manner similar to chaff and decoy cartridge dispensers used on aircraft. In these dispensers, the hot gases that eject the cartridge initiate a pyrotechnic delay element. At the end of the delay element burn, the charge inside the cartridge is initiated, producing an obscurant cloud.

Another method of use for this invention is as a crowd control device. The present invention can use agents, such as CS (Orthochloro-benzalmalononitrile) and OC (Oleoresin Capsicum), as filler for such purposes.

It should be understood that the foregoing summary, detailed description, examples and drawings of the invention are not intended to be limiting, but are only exemplary of the inventive features that are defined in the claims.

We claim:

1. An aerosol generating device, comprising:

at least one cartridge comprising a casing having a base end and a retainer end;

a firing initiator mounted in said base end, said initiator extending to a non-explosive propellant within said casing;

a diffuser inside said casing and on a side of said propellant opposite said base end;

a clearing pad inside said casing, said clearing pad being adjacent to said diffuser on a side of said diffuser opposite said base end;

a filler area inside said casing, said filler area being adjacent to said clearing pad on a side of said clearing pad opposite said base end, said filler area containing filler capable of forming an aerosol; and, a frangible end seal in said retainer end.

2. The device of claim 1, wherein the rate of reaction of said propellant is slower than the reaction rate of an explosive that generates a shock wave traveling at 2000 meters per second.

3. The device of claim 1, wherein said propellant is a double-base propellant.

4. The device of claim 1, further comprising a microprocessor to control the firing of the device.

5. The device of claim 4, further comprising a self-contained energy source for said initiator and said microprocessor.

6. The device of claim 1, wherein said at least one cartridge is incorporated into a smoke pot core.

7. The device of claim 6, wherein said smoke pot core is incorporated into an M2A1 ammunition-type carrying case.

8. The device of claim 1, further comprising an open area between said propellant and said diffuser.

9. The device of claim 1, wherein said filler is an obscurant material selected from the group consisting of titanium dioxide, brass flakes, carbon flakes, carbon fibers, graphite flakes, chaff, and combinations thereof.

10. The device of claim 1, wherein said filler is a crowd control or incapacitating composition selected from the group consisting of Ortho-chlorobenzalmalononitrile (CS) and Oleoresin Capsicm (OC).

11. The device of claim 1, wherein said filler does not decompose within said device.

12. A method for disseminating an aerosol, comprising: providing at least one device comprising at least one cartridge, said cartridge comprising a casing, having a base end and a retainer end;

a firing initiator mounted in said base end, said initiator extending to a non-explosive propellant within said casing, wherein the rate of reaction of said propellant is slower than the reaction rate of an explosive that generates a shock wave traveling at 2000 meters per second;

a diffuser inside said casing and on a side of said propellant opposite said base end;

a clearing pad inside said casing, said clearing pad being adjacent to said diffuser on a side of said diffuser opposite said base end;

a filler area inside said casing, said filler area being adjacent to said clearing pad on a side of said clearing pad opposite said base end, said filler area containing filler capable of forming an aerosol;

a frangible end seal in said retainer end; and actuating the device.

13. The method of claim 12, wherein said at least one device is capable of launching said at least one cartridge into the air prior to the initiation of aerosol dissemination.

* * * * *